US009911245B1

(12) United States Patent
Geist et al.

(10) Patent No.: US 9,911,245 B1
(45) Date of Patent: Mar. 6, 2018

(54) METHOD AND APPARATUS FOR USING A VEHICLE LICENSE TAG NUMBER FOR TOLL PAYMENT AS A BACKUP FORM OF ACCOUNT AUTHORIZATION

(71) Applicants: Wyatt Drake Geist, Davie, FL (US); Jaime Andres Borras, Pembroke Pines, FL (US)

(72) Inventors: Wyatt Drake Geist, Davie, FL (US); Jaime Andres Borras, Pembroke Pines, FL (US)

(73) Assignee: GeoToll, Inc., Cooper City, FL (US)

( * ) Notice: Subject to any disclaimer, the term of this patent is extended or adjusted under 35 U.S.C. 154(b) by 639 days.

(21) Appl. No.: 13/946,549

(22) Filed: Jul. 19, 2013

(51) Int. Cl.
*G07B 15/00* (2011.01)
*G07B 15/06* (2011.01)

(52) U.S. Cl.
CPC ..... *G07B 15/06* (2013.01)

(58) Field of Classification Search
CPC ..... G07B 15/063; G07B 15/00; G07B 15/06
USPC ..... 705/13
See application file for complete search history.

(56) References Cited

U.S. PATENT DOCUMENTS

2002/0072963 A1* 6/2002 Jonge ..... G07B 15/02 705/13
2002/0140577 A1* 10/2002 Kavner ..... G07B 15/06 340/933
2004/0083130 A1* 4/2004 Posner ..... G06Q 20/127 705/13
2004/0095258 A1* 5/2004 Bosch ..... G08G 1/017 340/937
2004/0206817 A1* 10/2004 Grant ..... G07B 15/063 235/384
2005/0197976 A1* 9/2005 Tuton ..... G06Q 30/0284 705/417
2006/0278705 A1* 12/2006 Hedley ..... G07B 15/063 235/384
2007/0008179 A1* 1/2007 Hedley ..... G07B 15/06 340/928
2007/0124198 A1* 5/2007 Robinson ..... G06Q 20/102 705/13
2007/0252678 A1* 11/2007 Garcia Alonso ..... G07B 15/063 340/10.31
2007/0285280 A1* 12/2007 Robinson ..... G07B 15/063 340/928
2008/0040210 A1* 2/2008 Hedley ..... G06Q 30/04 705/13
2008/0147491 A1* 6/2008 Robinson ..... G06Q 10/02 705/13

(Continued)

*Primary Examiner* — Brian Epstein
(74) *Attorney, Agent, or Firm* — The Concept Law Group, P.A.; Scott M. Garrett

(57) ABSTRACT

A method and apparatus for processing vehicle license tag numbers allows subscribers of a toll service to avoid additional charges normally associated with processing photographs of vehicle license tags by toll agencies to collect tolls. A subscriber can upload one or more license tag numbers to be associated with the subscriber's account with the toll service. The toll service provides a list of license tag numbers to the toll agency. If, for a given toll event, the toll agency does not receive a response to a wireless toll tag reader signal, the toll agency compares a license tag number obtained by processing a photo of the vehicle's license tag with the list provided by the toll service to find a match and process the toll.

6 Claims, 4 Drawing Sheets

(56) References Cited

U.S. PATENT DOCUMENTS

| | | | | |
|---|---|---|---|---|
| 2008/0206817 | A1* | 8/2008 | Brass | C12N 15/78 435/69.6 |
| 2010/0106567 | A1* | 4/2010 | McNew | G06Q 10/06 705/13 |
| 2011/0047009 | A1* | 2/2011 | Deitiker | G07B 15/063 705/13 |
| 2011/0208568 | A1* | 8/2011 | Deitiker | G07B 15/063 705/13 |
| 2013/0346165 | A1* | 12/2013 | Hedley | G06Q 30/0283 705/13 |
| 2015/0049914 | A1* | 2/2015 | Alves | G06K 9/033 382/105 |

* cited by examiner

METHOD AND APPARATUS FOR USING A VEHICLE LICENSE TAG NUMBER FOR TOLL PAYMENT AS A BACKUP FORM OF ACCOUNT AUTHORIZATION

FIELD OF THE DISCLOSURE

The present disclosure relates generally to automated vehicular toll systems and more particularly to providing a back-up payment means in a toll system when a toll tag is either inoperable or not present.

BACKGROUND

In current vehicular toll systems it is common to automate toll payment by use of a toll tag in the vehicle. A toll tag is a radio frequency identification (RFID) tag device that responds to a read signal transmitted from a vehicular toll gateway. The read signal is transmitted by a reader associated with a lane controller. Upon receiving the read signal, the RFID tag device responds by transmitting an identifier that is associated with an account, assuming the RFID tag device is operable or present in the vehicle. Such toll gateways allow drivers to drive through the toll gateway at normal speed, without having to slow down or stop. In case the reader does not receive a response, as the vehicle passes through the toll gateway, a picture is taken of the vehicle's license tag. As a default, some toll agencies take a picture of every vehicle's license tag in the event the received identifier fails to authenticate or is not associate with a valid account.

Settlement of tolls is typically done in batch processes where a received identifier is used to identify an account with the toll agency, and the account is debited accordingly. If no valid identifier is received for a given vehicle, the toll agency must cross reference the license tag number with a government registration database. This typically accrues additional charges. An infraction invoice for the cost of the toll and additional charges associated with processing the license tag information is then sent to the registered owner of the vehicle.

Similarly, a person who rents a car, such as on a business trip, may have to stop and pay tolls manually since the renter does not have a suitable toll tag to use. If a vehicle renter goes through a wireless toll gateway, the toll agency will issue an infraction invoice to the rental agency, who will in turn charge the renter.

Accordingly, there is a need for a method and apparatus for an alternate way to pay tolls without additional charges when the vehicle has no toll tag or an inoperative toll tag.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
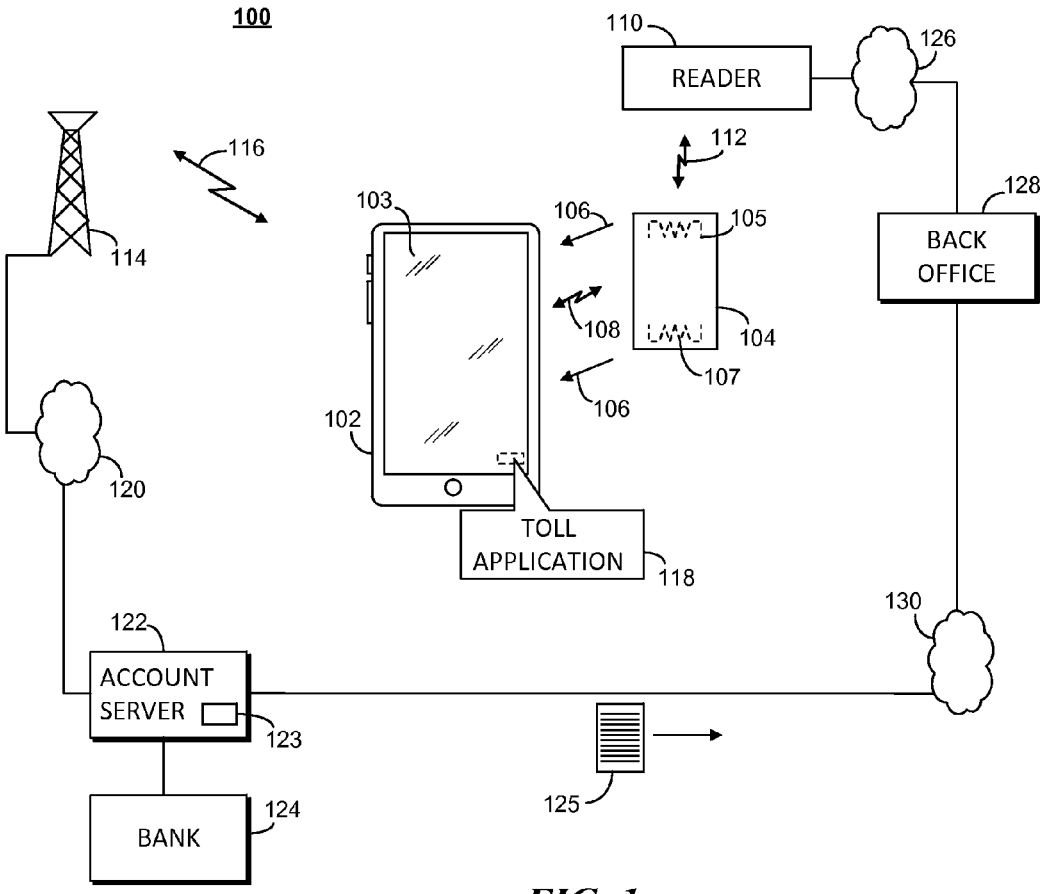
FIG. 1 is a system of a mobile device and RFID tag device in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

Embodiments discussed and taught herein include a method for using a vehicle license tag number for toll payment with a toll agency as a backup form of account authorization. The method includes receiving, at a toll application of a mobile device, an input including a vehicle license tag number. The input is provided by a subscriber of a toll service that maintains an account for the subscriber, and settles toll transactions with the toll agency on behalf of the subscriber. The method further includes transmitting the license tag number and account credentials to an account server of the toll service. The toll service is separate from the toll agency. The account server maintains an account for the subscriber and associates subscriber information with an account identifier, including the input vehicle license tag number or numbers. The method further includes storing the license tag number in association with the account based on the credentials. The method further includes transmitting, by the account server, a tag number list including the license tag number to a back office server of the toll agency. The toll agency uses the license tag number to reconcile payment for tolls accrued by a vehicle having the license tag number from the account.

FIG. 1 is a toll service system 100 that facilitates the use of a mobile device 102 and RFID tag device 104 to pay tolls in accordance with some embodiments. Normally the mobile device 102 operates in conjunction with the RFID tag device 104 to effect payment of tolls to a toll agency, but in some cases the RFID tag device may be inoperable, or the mobile device may be off and unable to power the RFID tag device, the RFID tag device may be out of range or have a weak signal, or the user may simply not have the mobile device at the time. In general, the mobile device 102 includes a toll application 118 that allows the user of the mobile device 102 to enter and submit a vehicle license tag number to an account 123 on an account server 122 operated by a toll service that is separate and independent of the toll agency. The toll service facilitates toll payments on behalf of subscribers by interactions with the toll agency. When an RFID tag device is not read by toll gateway as a vehicle passes by the toll gateway, the toll gateway takes a picture of the license tag of the vehicle to be used as a backup means to acquire payment. The toll service can provide a list of license tag numbers of accounts in good standing and matches can be found so that associated accounts can be appropriately debited and more expensive infraction invoicing can be avoided. It will be appreciated by those skilled in the art that the term "license tag number" refers to the alphanumeric characters on a vehicular license tag or registration tag, which is typically required for operation on public roadways and is typically prominently displayed on the front and/or back of the vehicle to which it is registered.

The mobile device 102 is a small, portable computing device that includes one or more radio transceivers. Examples of mobile devices include, for example, cellular or "smart" phones, tablet computing devices, personal digital assistants, and so on. In addition to radio interface(s), a mobile device 102 includes a graphical display 103 and input means to allow a user of the mobile device 102 to interact with, and control operation of the mobile device 102, as well as memory and a processor to execute program code for applications, programs, operating systems, and other software elements. The memory includes read only memory (ROM) and random access memory (RAM), and can include other types of memory such as flash memory, and can include memory expansion such as memory card slots.

The RFID tag device 104 contains identity information that can be used for conducting wireless transactions as well as radio communication means to communicate with the mobile device 102 and toll readers 110. Accordingly, the RFID tag device 104 can have two radio frequency (RF) interfaces. A RF interface which is a wireless radio interface and includes an antenna and transceiver that operate according to a defined protocol or air interface. The air interface defines channel format, timing, modulation, and other aspect for radio communication. The RFID tag device 104 can include a first RF interface 107 to communicate with the mobile device 102 via radio link 108, and a second RF interface 105 to communicate with another device, such as an RFID reader 110, over radio link 112. The radio links 108, 112 indicate communication between the devices over their respective RF interfaces. The RFID tag device 104 can be held against, or substantially close to the mobile device 102, such as by forming the RFID tag device 104 in the form of a card with an adhesive layer to affix the RFID tag device 104 onto a surface (such as a back surface) of the mobile device 102 as indicated by arrows 106. In some embodiments the mobile device 102 and RFID tag device 104 can communicate via radio link 108 using a near field communication (NFC) protocol, such as that specified by ISO/IEC 18000-3 which has an effective range of about 10 cm and operates at 13.56 MHz. Typically the NFC communication between the mobile device 102 and the RFID tag device 104 will be encrypted for security purposes. In addition to exchanging data over the radio link 108, the mobile device 102 can power the RFID tag device 104 via radio link 108. The energy of the NFC signal from the mobile device can be collected in the RFID tag device and used to by the RFID tag device 104 to respond to the mobile device over link 108, as well as for RFID operations via radio link 112. Radio link 112 between the RFID tag device and RFID reader 110 can be a RFID interface, such as, for example, that specified by ISO/IEC 18000-6c, ISO/IEC 18000-6b, or other known RFID interface standards. In some embodiments, the link 112 can be specifically configured to operate according to a vehicular toll standard for use in wireless tollway systems. In such embodiments, the RFID reader 110 can be a tollway reader that is positioned over a traffic lane of a toll road. The RFID reader 110 includes an antenna and transceiver to support communications with RFID tag devices, as is known. As the RFID tag device 104 passes by the reader 110, a signal from the reader 110 causes the RFID tag device 104 to respond via link 112 with identification information to identify the RFID tag device 104. Furthermore, the reader 110 can, in some embodiments, transmit transaction information to the RFID tag device 104 via link 112. The transaction information can include information such as an identification of the reader 110, location, a toll amount, the time, and so on. In some embodiments the reader 110 does not transmit transaction information to the RFID tag device 104, and the RFID tag device 104 only indicates to the mobile device 102 that it has been read (i.e. that it has responded to a reader signal). In some embodiments the reader 110 may also write information to the RFID tag device 104.

The mobile device 102 contains a toll application 118 that allows the mobile device 102 to facilitate transactions, including processing transaction information received from the RFID tag device 104 or transaction information generated by the mobile device 102 upon receipt of an indication of a transaction by the RFID tag device 104, and forwarding the transaction information to an account server 122. The toll application also allows a user of the mobile device to configure and edit a toll account 123 on a remotely located account service operated by a toll service to which the user of the mobile device can subscribe. The toll service is an independent corporate entity that provides payment information to toll agencies on behalf of subscribers of the toll service. One information item that can be maintained in the account 123 is one or more vehicle license tag numbers of vehicles operated by the user of the mobile device 102 or owner of the account 123. The vehicle license tag number is used as a back-up means of reconciling payment so as to avoid infraction or violation charges if the RFID tag device 104 fails to be read by a toll gateway upon passing through the toll gateway.

In some embodiments the mobile device 102, in addition to the radio interface to support radio link 108, comprises another radio interface to communicate at farther distances, such as a cellular transceiver for communicating over a cellular radio telephony link 116 with a cellular telephony infrastructure network 114. The cellular radio telephony link 116 is operated in accordance with a cellular data communications standard, such as, for example, the Long Term Evolution (LTE) standard, the Global System for Mobile Communications (GSM) Enhanced Data rates for GSM Evolution (EDGE), or code division multiple access (CDMA), among other known standards. The mobile device 102 can transmit transaction information over the cellular telephony radio link 116, through a wide area network 120, such as the Internet, to the account server 122 that maintains the account information for the account 123 associated with the mobile device 102, the RFID tag device 104, or an owner or agent who operates the mobile device 102 and RFID tag device 104.

The account server 122 can be linked to one or more banks 124 to maintain funding for transactions applied to the account 123 associated with the RFID tag device 104. The account 123 can be accessed by the toll application 118 executing on the mobile device 102 by presenting appropriate credentials (e.g. user name and password).

The account server 122 can communicate with a back office server 128 that is operated by a toll agency. A toll agency is an entity that operates the toll equipment and collects tolls. The back office service 128 is associated with reader 110 over similar, if not the same, networks 126, 130. The back office server 128 logs transaction information and reconciles payment of funds due with the account server 122. Processing the transaction information is typically performed by batch processing, although in some embodiments it is contemplated that processing can be performed on a per-transaction or per-occurrence basis. The account server 122 can verify transactions based on transaction information received from the mobile device 102. Typically the identifier read from the RFID tag device 104 is used to reconcile transactions. However, in the event that the identifier is not read, as each vehicle passes through a toll gateway, a photograph is taken of the vehicle's license tag. The photograph can be processed to acquire the license tag number, such as by optical character recognition. The license tag number acquired from the photograph can be cross referenced against a license tag number list 125 of license tag numbers provided by the account server 122 to the toll agency (i.e. back office server 128), which are each associated with an account in good standing. If a match is found, then the corresponding account is debited for the toll. If a match is not found, then the toll agency can commence an infraction process where a government-maintained database is queried to determine the registered owner of the vehicle based on the license tag number acquired from the photograph, and an infraction invoice is sent to the registered owner. In some embodiments the list 125 comprises a single license tag number that the toll agency can add to a presently existing list, such as when the user has rented a vehicle and needs the license tag number of the rental vehicle added immediately.

Figure 2:
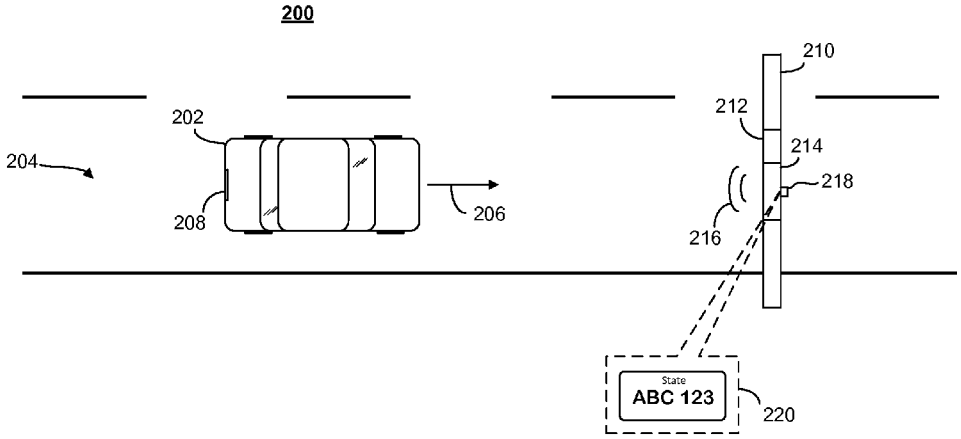
FIG. 2 is a diagram of a vehicular toll gateway in accordance with some embodiments.

FIG. 2 is a diagram of a vehicular toll gateway 200 in accordance with some embodiments. A vehicle 202 travels on a roadway lane 204 towards a toll gateway 210 in the direction of arrow 206. The vehicle 202 has a license tag 208 mounted on the back of the vehicle 202. As the vehicle 202 approaches the toll gateway 210, its approach can be detected, such as by a magnetic loop in the roadway 204. Upon detecting the approaching vehicle, a lane controller 212 enables a reader 214 which begins transmitting a read signal 216. When a functional RFID toll tag device is present in the vehicle 202, it will respond to the read signal by transmitting an identifier that can be used to debit an account associated with the identifier. Furthermore, as the vehicle 202 passes the toll gateway 210, a camera 218 is used to take a photograph 220 of the license tag 208, which is stored either at the lane controller 212 or a toll agency back office server. Periodically, the toll agency operating the toll gateway 210 processes the accumulated toll information to collect toll funds. Each passing vehicle generates a toll event for which a toll must be collected. When a toll event is generated, the lane controller 212 stores an identifier, if one is received, and a photograph of the passing vehicle license tag. If no identifier is received, then the toll authority must process the photograph to obtain the license tag number, which is first compared to the list of license tag numbers from the toll service (e.g. account server 122 of FIG. 1) to see if there is a match. Matches allow the associated account to be debited. Non-matching license tag numbers will require infraction processing.

Figure 3:
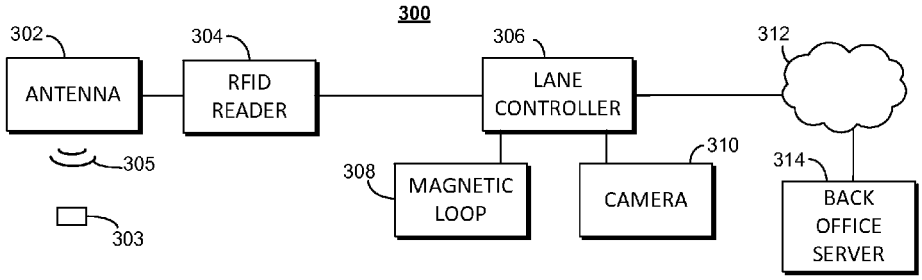
FIG. 3 is a block schematic diagram of a vehicular toll gateway in accordance with some embodiments.

FIG. 3 is a block schematic diagram of a vehicular toll gateway 300 in accordance with some embodiments. The toll gateway 300 can be an example of toll gateway 210 of FIG. 2. An antenna 302 is used to transmit a read signal 305 which can be received by an RFID tag device 303, if present. The RFID tag device 303 can respond by transmitting an identifier. The antenna 302 is coupled to an RFID reader 304 that contains a radio frequency transceiver for modulating and demodulating signals. Signals received from an RFID tag device are demodulated to obtain the identifier, which is provided to a lane controller 306. The lane controller 306 can detect the approach of a vehicle using a magnetic loop sensor 308, which initiates a toll event. For each toll event, the lane controller 306 attempts to read an RFID tag device to acquire an identifier, and it take a photograph of the vehicle's license tag with a camera 310 as the vehicle passes. The lane controller 306 is coupled to a back office server 314 through a network 312, such as the internet. The back office server 314 receives account information for the settlement of tolls. The account information can include identifiers and license tag numbers. When there is no received identifier for a given toll event, or if the received identifier fails to match any account, the toll agency, at the lane controller 306 or the back office server 314, tries to match the license tag number acquired from the photograph recorded for the toll event with a license tag number on a list of tag numbers provided by a toll service. When a match is found, the associated account of the matching license tag number is debited for the toll amount. If no match is found, then an infraction process is commenced.

Figure 4:
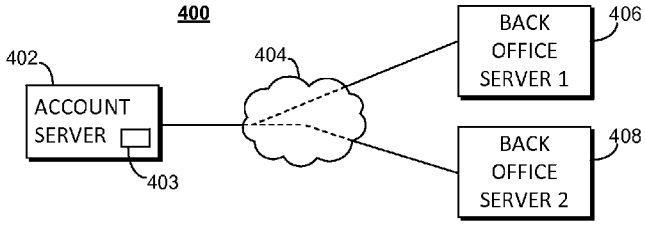
FIG. 4 is a block diagram of a toll service account server that provides account information to multiple toll agency servers for different and independent toll agencies in accordance with some embodiments.

FIG. 4 is a block diagram 400 of a toll service account server 402 that provides account information to multiple toll agency servers 406, 408 for different or independent toll agencies in accordance with some embodiments. The account server 402 is operated by a toll service that is separate from the toll agency or agencies that operate the back office servers 406, 408. The back office servers 406, 408 can belong to the same toll agency or different toll agencies. They can be used in different regions and/or different jurisdictions. The account server 402 can connect to the back office servers 406, 408 via a network 404, such as the Internet. Likewise, each back officer server 406 can connect to other account servers 402, including account servers for toll services other that the toll service operating account server 402. The account server 402 transmits a list of license tag numbers 403 for accounts in good standing to the back office servers 406, 408 to be used in the matching process, when needed, to identify accounts and avoid infraction processing.

Figure 5:
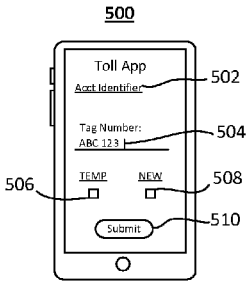
FIG. 5 is a diagram of a mobile device running a toll application in accordance with some embodiments.

FIG. 5 is a diagram of a mobile device 500 running a toll application in accordance with some embodiments. The toll application is executed by the mobile device 500, and can provide several different interfaces to interact with and configure account parameters and information. The toll application can display an account number 502 or other identifier that is unique to an account. The toll application also allows the user to enter a license tag number 504, such as by text entry. The toll application can further allow the user to indicate if the license tag number 504 is either a temporary license tag number 506 or a new license tag number 508. Once the user enters a license tag number and selects the a setting 506, 508, the user can then submit the information to the account server by activating a submit button icon 510. Upon activating the submit button, the mobile device 500 can submit the license tag number information to the account server for storage in association with the user's account.

Figure 6:
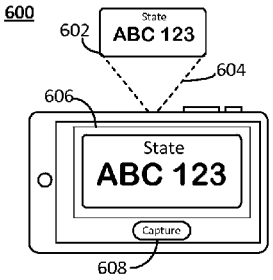
FIG. 6 is a diagram of a mobile device that photo processes an image of a vehicle license tag into a toll application in accordance with some embodiments.

FIG. 6 is a diagram of a mobile device 600 that photo processes an image of a vehicle license tag 602 into a toll application in accordance with some embodiments. In particular, the toll application can have a camera interface to utilize an on-board camera of the mobile device to capture a photographic image of a vehicle license tag 602. A user of the mobile device can aim the camera on the mobile device so that the vehicle license tag is in a field of view 604 of the camera. The toll application photograph interface can present an image 606 on a display of the mobile device. Once the vehicle license tag is properly in view, the user can activate a "capture" button icon 608, for example, to cause the toll application to capture an image of the license tag. The toll application can further process the image to determine the license tag number, such as by using an optical character recognition process, and can prompt the user to indicate whether the license tag number is a new one, a replacement of one on record, or a temporary one. Once the license tag number is acquired, the toll application can upload the license tag number to an account server to be stored in association with the user's account (as indicated by the log-in credentials used by the toll application). Once uploaded, the account server can add the license tag number to a list of license tag numbers of accounts in good standing that can be submitted to toll agencies for toll processing in case of a failure to read the RFID toll tag device occurs during a toll event.

Figure 7:
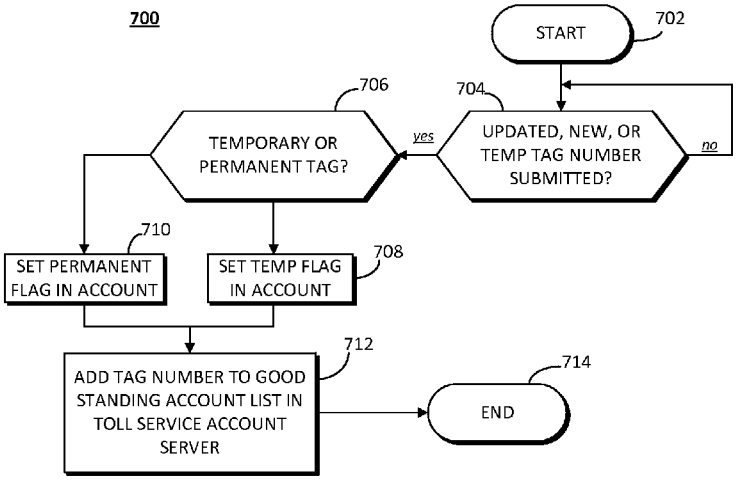
FIG. 7 is a flowchart diagram of a method for registering a license tag number with an account in accordance with some embodiments.

FIG. 7 is a flowchart diagram of a method 700 for registering a license tag number with an account in accordance with some embodiments. In particular, the license tag number is registered to an account for a subscriber of a toll service. The toll service operates as a payment service to settle vehicular toll transactions incurred by the subscriber, and is an independent organization from the toll agency or toll authority that operates the toll equipment and collects tolls. At the start 702, the subscriber/user can enable a toll application on a mobile device or other sufficient computing equipment, which causes the toll application to log-in to the subscriber's account using credentials provided by the user, and which may be stored locally in the device on which the toll application runs. The toll application is a software program that can be instantiated on the mobile device or other computing equipment and can present an initial interface with options to bring up and display other interfaces for performing various account operations. The toll application can be operated to bring up a registration interface for adding/changing registered license tag numbers of vehicles used by the subscriber, including temporary vehicles such as rental vehicles. Accordingly, the subscriber first enters in one or more license tag numbers into the toll application and submits them, causing the toll application to upload them to an account server. The account server determines that new license tag numbers have been submitted in process 704. The account server then determines whether each submitted license tag number is a permanent license tag number (meaning to be kept indefinitely) or a temporary license tag number. A temporary license tag number can be, for example the license tag number of a rental vehicle, or a temporary license tag number given for a recently purchased vehicle until a permanent license tag is issued. Accordingly, the temporary license tag number can have a valid time period associated with it so that it expires and toll events resulting from that vehicle will not be debited against the subscriber's account after expiration. The account server determines whether each submitted license tag number is permanent or temporary in process 706, and flags them accordingly in processes 708, 710. The account server then adds the submitted license tag numbers to the corresponding account and associates them with the subscriber's account. They can also be added to a license tag number list of accounts in good standing by the toll service in process 712. The list of accounts in good standing associates each license tag number with an account, and allows the toll agencies to match license tag numbers acquired from photographs taken for toll events with license tag numbers on the list and settle toll transactions by debiting the account associated with the license tag number. The method then ends in process 714, allowing the user to conduct some other operation with the toll application or simply exit out of the toll application.

Figure 8:
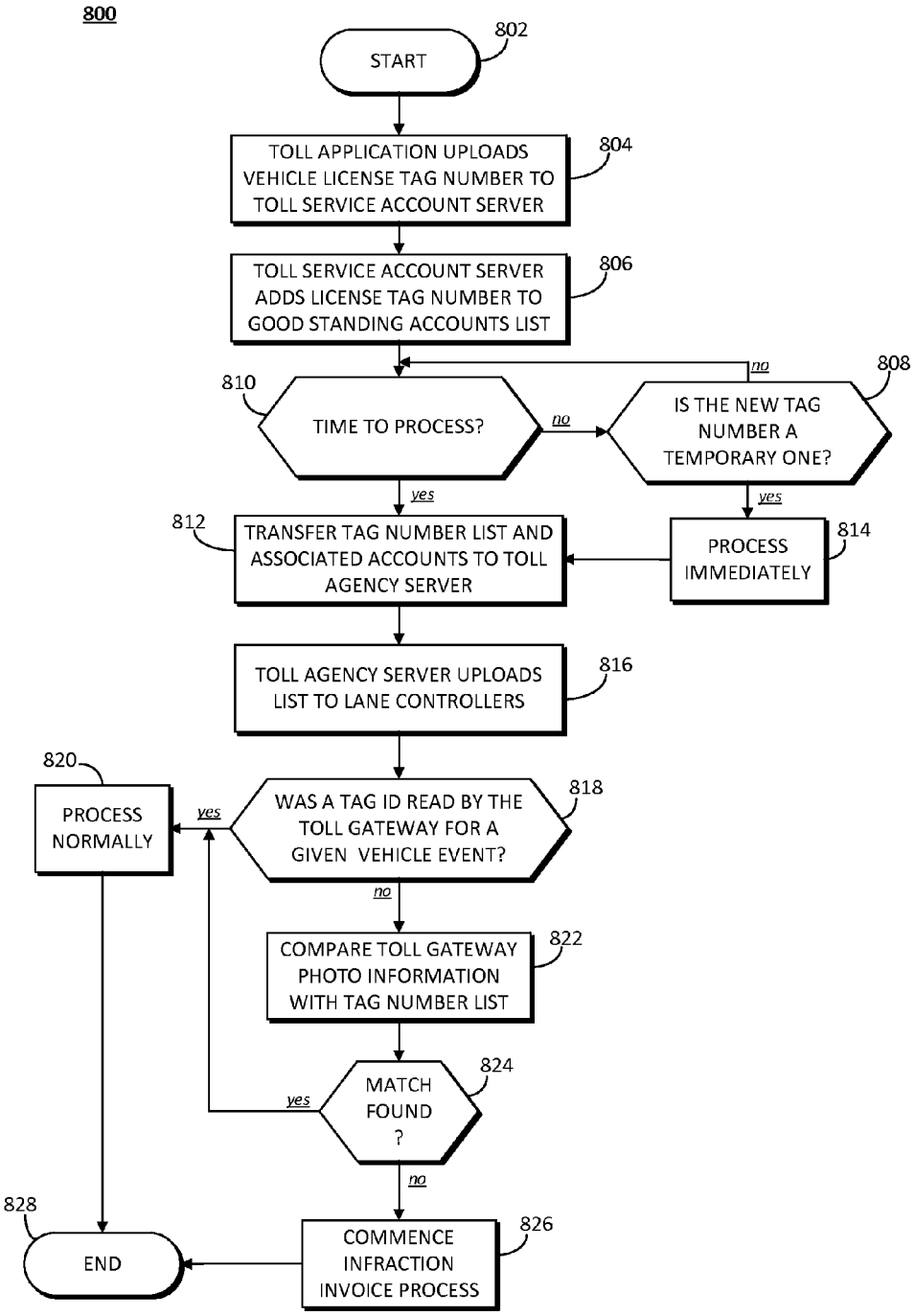
FIG. 8 is a flowchart diagram of a method for using a vehicle license tag number for toll payment with a toll agency as a backup form of account authorization in accordance with some embodiments.

FIG. 8 is a flowchart diagram of a method 800 for using a vehicle license tag number for toll payment with a toll agency as a backup form of account authorization in accordance with some embodiments. The method 800 is an exemplary method for processing toll transactions where a RFID toll tag device failed to respond, either by being inoperable or simply not present, when a vehicle passes through or past a toll gateway and generates a toll event.

At the start 800 a subscriber or user of a toll service uses a toll application on appropriate computer equipment to upload one or more vehicle license tag numbers to be associated with the subscriber's account in process 804. The toll service's account server then adds the subscriber's license tag numbers to the subscriber's account and to a list of license tag numbers that the toll service sends to toll agencies to settle tolls in process 806. Processes 804, 806 can be performed in accordance with the method of FIG. 7, and are performed as a preliminary matter before the subscriber uses the corresponding vehicle(s) on tollways. Subsequent to performing processes 804, 806, the subscriber then operates the corresponding vehicle or vehicles on tollways, resulting in toll events that need to be settled.

Periodically, the toll agency will process toll events to collect tolls. Typically this processing is done daily. Accordingly the toll service determines a time process toll events in process 810 as a batch process. When the time to process the license tag number list arrives, the license tag number list is then transferred from the toll service (i.e. from an account server) to the toll agency (i.e. a back office server of the toll agency), as indicated in process 812. However, it is contemplated that temporary license tag numbers may need more timely processing as indicated in decision box 808. Temporary license tag numbers can be uploaded to a toll agency as needed, or immediately, as indicated by process 814, rather than waiting for a batch processing time since the temporary license tag registration to a subscriber's account may expire before the time for batch processing occurs, such as a vehicle for business rental for only part of a day.

Upon receiving the list of license tag numbers, the toll agency can upload the list to each lane controller for processing as indicated in process 816, or the back office server or other equipment of the toll agency can process the list. In processing toll events, the toll agency equipment first determines, for each toll event, whether a valid identifier was received, as indicated in process 818. If a valid identifier was received from the vehicle, then the toll is processed normally in box 820 and the corresponding account is debited to settle the toll due. If the vehicle did not respond with a valid identifier, or at all, then the toll agency equipment can process the photograph taken and stored in conjunction with the toll event to acquire the license tag number of the vehicle generating the toll event and compare with the list of vehicle license tag numbers provided to the toll agency by the toll service, as indicated in process 822, to determine if there is a match. A match occurs when the license tag number of the vehicle generating the toll event is found on the list of license tag numbers provided to the toll agency by the toll service. When a match is found, the toll agency uses the license tag number to process the toll settlement with the toll service. The toll service cross references the matching license tag number to the corresponding subscriber account and debits the account accordingly. If a match is not found by the toll agency, as in process 824, the toll agency then commences an infraction invoicing process 826 where, for example, the toll agency queries a government-maintained database of vehicle registrations to obtain owner information for the vehicle that generated the toll event. Typically the government agency charges for each such query, and that charge is added to the toll amount. The toll agency can then invoice the owner of the vehicle, such as by mailing an invoice for the toll and any additional charges or fees due, along with an indication that failure to pay the invoiced amount can result in a civil infraction.

Accordingly, the method and apparatus of the embodiments exemplified herein provide a means for vehicle operators to have tolls normally processed without additional penalties by registering one or more vehicle license tag numbers with their toll service account. The toll service provides registered license tag numbers for accounts in good standing to a toll agency. This allows subscribers of the toll service to avoid additional charges when their toll tag device fails or is not present in their vehicle. The license tag numbers are processed as a back-up means if the toll agency does not receive a valid identifier in response to the read signal at a toll gateway during a toll event.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. A method of reconciling toll accounts by a toll agency, comprising:

receiving, at a toll gateway from an account server operated by a toll account service that is separate from the toll agency at a batch processing time, a license tag number list including a plurality of license tag numbers, wherein each of the plurality of license tag numbers is associated with a valid account of a plurality of valid accounts, wherein the toll gateway includes at least one lane controller;

uploading the license tag number list to the at least one lane controller in response to receiving the license tag number list at the batch processing time;

receiving, at the toll gateway from the account server, at a time other than the batch processing time, a temporary license tag number that is temporarily associated with one of the valid accounts;

uploading the temporary license tag number to the at least one lane controller upon receiving the temporary license tag number at the toll gateway and the at least one lane controller adding the temporary license tag number to its respective license tag number list;

detecting, at the at least one lane controller, a vehicle approaching the vehicular toll gateway;

attempting to read a radio frequency identification (RFID) toll tag of the vehicle by the at least one lane controller;

capturing and storing an image of a license tag of the vehicle by the at least one lane controller as it passes the vehicular toll gateway;

failing to receive a response to the attempt to read a RFID toll tag;

in response to failing to receive a response to the attempt to read a RFID toll tag, determining, by the at least one lane controller, that a license tag number shown in the image of the license tag matches the temporary license tag number in the license tag number list stored at the at least one lane controller; and debiting an account associated with the temporary license tag number in the license tag number list.

2. The method of claim 1, wherein failing to receive a response to the attempt to read a RFID tag is due to a lack of an RFID toll tag in the vehicle.

3. The method of claim 2, wherein failing to receive a response to the attempt to read a RFID tag is due to the RFID toll tag not being powered on by an associated mobile device upon the vehicle approaching the toll gateway.

4. A vehicular toll system, comprising:

a vehicular toll gateway including at least one lane controller that operates a reader, a vehicle detection means, and a camera, wherein the reader transmits a read signal in response to an approaching vehicle being detected by the vehicle detection means and the camera takes a photograph of a license tag of the vehicle as it passes the vehicular toll gateway and stores the photograph in association with a toll event; and back office server coupled to the vehicular toll gateway that receives a vehicle license tag number list from an account server of a toll service at a batch processing time and uploads the vehicle license tag number list to each lane controller of the vehicular toll gateway, the vehicle license tag number list includes at least one license tag number and indicates an account associated with the at least one license tag number for a subscriber of the toll service, and wherein the back office server further receives temporary license tag numbers at times other than the batch processing time and uploads the temporary license tag numbers to each lane controller upon receiving each temporary license tag number, wherein each lane controller adds each temporary license tag number to the vehicle license tag number list stored at each lane controller;

wherein the vehicular toll system:

detects an approaching vehicle at one of the lane controllers;

attempts to read a RFID toll tag in response to detecting the approaching vehicle by transmitting a read signal from the reader of the lane controller;

determines that a response to the read signal was not received at the reader;

in response not receiving a response to the read signal, the lane controller determines a license tag number of the vehicle from the photograph; and in response to a determination that no response to the read signal is received, the lane controller determines that the license tag number of the vehicle matches a temporary license tag number in the vehicle license tag number list stored at the lane controller.

5. The vehicular toll system of claim 4, further comprising, when the vehicular toll system determines that the vehicle license tag number matches the temporary license tag number in the vehicle license tag number list, the back office server debits the account associated with temporary license tag number in the vehicle license tag number list.

6. The vehicular toll system of claim 4, further comprising, a vehicle toll tag that includes a first interface for receiving power from an associated mobile device and a second interface for receiving and responding to the read signal from the reader, and wherein the lane controller making the determination that a response was not received is caused by the mobile device failing to power the vehicular toll tag through the first interface.

* * * * *